US009016652B2

(12) United States Patent
Belyea et al.

(10) Patent No.: US 9,016,652 B2
(45) **Date of Patent: *Apr. 28, 2015**

(54) CORNER PROTECTOR

(75) Inventors: Vianka P. Belyea, Boston, MA (US); Tavinder Phull, Newton, MA (US); Graeme Wagoner-Lynch, Portland, OR (US)

(73) Assignee: Rhoost, LLC., Newton, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/486,694

(22) Filed: Jun. 1, 2012

(65) Prior Publication Data

US 2012/0235004 A1 Sep. 20, 2012

Related U.S. Application Data

(63) Continuation of application No. 12/544,685, filed on Aug. 20, 2009, now Pat. No. 8,201,796.

(51) Int. Cl.
*A47B 95/00* (2006.01)
*A47B 95/04* (2006.01)

(52) U.S. Cl.
CPC ..... *A47B 95/043* (2013.01)

(58) Field of Classification Search
CPC ..... A47B 95/043
USPC ..... 248/345.1, 74.4, 74.3, 74.5, 229.12, 248/319.4; 206/453, 586; 410/41, 99; 52/3; 108/27; 150/158; 109/37
See application file for complete search history.

(56) References Cited

U.S. PATENT DOCUMENTS

| | | | | |
|---|---|---|---|---|
| 3,093,924 | A | 6/1963 | Pompa | |
| 3,144,236 | A | 8/1964 | Clanin | |
| 3,302,782 | A | 2/1967 | Pezely, Jr. | |
| 3,720,035 | A | 3/1973 | Rutter | |
| 3,725,188 | A | 4/1973 | Kalt | |
| 3,731,347 | A * | 5/1973 | Caveney et al. | 24/16 PB |
| 3,915,434 | A | 10/1975 | Lister | |
| 3,971,105 | A * | 7/1976 | Caveney | 24/16 PB |
| 4,063,702 | A | 12/1977 | Wilde et al. | |
| 4,072,231 | A | 2/1978 | Helms | |
| D249,314 | S | 9/1978 | Wilde et al. | |
| 4,134,496 | A | 1/1979 | Smith | |
| 4,356,599 | A * | 11/1982 | Larson et al. | 24/16 PB |
| 4,395,009 | A * | 7/1983 | Bormke | 248/68.1 |
| D302,789 | S | 8/1989 | Levine | |

(Continued)

FOREIGN PATENT DOCUMENTS

| | | |
|---|---|---|
| CA | 2487518 A1 | 6/2005 |
| CA | 2505163 A1 | 10/2006 |

(Continued)

*Primary Examiner* — Kimberly Wood
(74) *Attorney, Agent, or Firm* — Wilmer Cutler Pickering Hale and Dorr LLP

(57) ABSTRACT

A corner protector comprising a guard, strap, and plate or rod are disclosed. The second portion and third portion of the guard are substantially orthogonal to the first portion, and to each other. The second portion and third portion meet to define a corner protrusion. The guard has interior extending ribs that are substantially vertical and maintain contact with the guard. The strap has at least one connection member on each end to allow the corner protector to be adjusted vertically. The plate or rod has at least one locking member for creating a locking mechanism with the connection member.

20 Claims, 6 Drawing Sheets

(56) References Cited

U.S. PATENT DOCUMENTS

| | | | | |
|---|---|---|---|---|
| 5,149,575 | A | 9/1992 | Soifer | |
| 5,161,692 | A | 11/1992 | Krierim | |
| 5,518,118 | A | 5/1996 | Pulz et al. | |
| 5,612,509 | A * | 3/1997 | Market | 174/53 |
| 6,036,155 | A | 3/2000 | Tsui | |
| 6,039,184 | A | 3/2000 | Gale | |
| 6,368,694 | B1 | 4/2002 | Marsh et al. | |
| 6,402,096 | B1 * | 6/2002 | Ismert et al. | 248/68.1 |
| 6,463,631 | B2 * | 10/2002 | Noda | 24/16 R |
| 6,478,354 | B1 | 11/2002 | Eyal | |
| D489,969 | S | 5/2004 | Gelbart | |
| 6,860,455 | B1 * | 3/2005 | Richardson | 248/74.1 |
| 7,191,988 | B2 * | 3/2007 | Kim et al. | 248/68.1 |
| 7,413,157 | B2 | 8/2008 | Curnow et al. | |
| 7,604,125 | B2 | 10/2009 | Cheng et al. | |
| 7,828,151 | B2 | 11/2010 | Murdoch | |
| 2002/0056656 | A1 | 5/2002 | Beliveau | |
| 2005/0050688 | A1 | 3/2005 | VanderWerf et al. | |
| 2005/0092633 | A1 | 5/2005 | Baechie | |
| 2006/0231691 | A1 * | 10/2006 | Edgren | 248/74.3 |
| 2006/0243636 | A1 | 11/2006 | Robichaud et al. | |
| 2007/0039848 | A1 | 2/2007 | Burchell | |
| 2007/0138350 | A1 * | 6/2007 | Brown et al. | 248/65 |
| 2007/0251855 | A1 | 11/2007 | Curnow et al. | |
| 2008/0067104 | A1 | 3/2008 | Curnow et al. | |

FOREIGN PATENT DOCUMENTS

| | | | |
|---|---|---|---|
| EP | 1937573 | A1 | 7/2008 |
| WO | WO-2007/045822 | | 4/2007 |

* cited by examiner

CORNER PROTECTOR

CROSS-REFERENCE TO RELATED APPLICATION

This application is a continuation of application Ser. No. 12/544,685, filed Aug. 20, 2009, now U.S. Pat. No. 8,201,796, which is incorporated herein by reference in its entirety.

BACKGROUND

With small children and elderly people in the home, it can be useful to protect them from injuries caused by accidents that can occur when a person hits sharp or pointed edges of furniture, such as tables and counters. Some corner protectors currently on the market require adhesives or screws for connecting edge protectors, but these products can damage furniture.

SUMMARY

A corner protector has a guard, strapping, and a plate. The guard has a top portion and also first and second side portions that are substantially orthogonal to the top portion, and to each other. The first and second portions meet to define a corner protrusion. The guard has inwardly extending ribs that maintain contact with the table when the corner protector is in place. The ribs can help absorb and redistribute force when pressure is applied to the guard.

The corner protector is non-permanently clamped to a sharp or projecting edge, such as on a table, by placing the guard coupled with the strap on top of the corner to be protected. The strap has at least one connection member on each end to allow the corner protector to be adjusted vertically. In one embodiment, a plate with locking members is used to secure the strap. In another embodiment, a rod with locking members is used to secure the strap.

Once the corner protector is clamped to the table, pressure applied to the exterior surfaces of the corner protector is distributed throughout the corner protector and to the table. This helps reduce the severity of injuries suffered when individuals fall onto the corner protector. Further, the locking mechanism used to secure the corner protector to the edge is easily removable, and does not require the use of adhesives or mechanical means that can damage furniture.

BRIEF DESCRIPTION OF THE DRAWINGS

The foregoing and other objects of the present inventions, the various features thereof, as well as the inventions themselves, may be more fully understood from the following description, when read together with the accompanying drawings, in which.

DETAILED DESCRIPTION

Figure 1A:
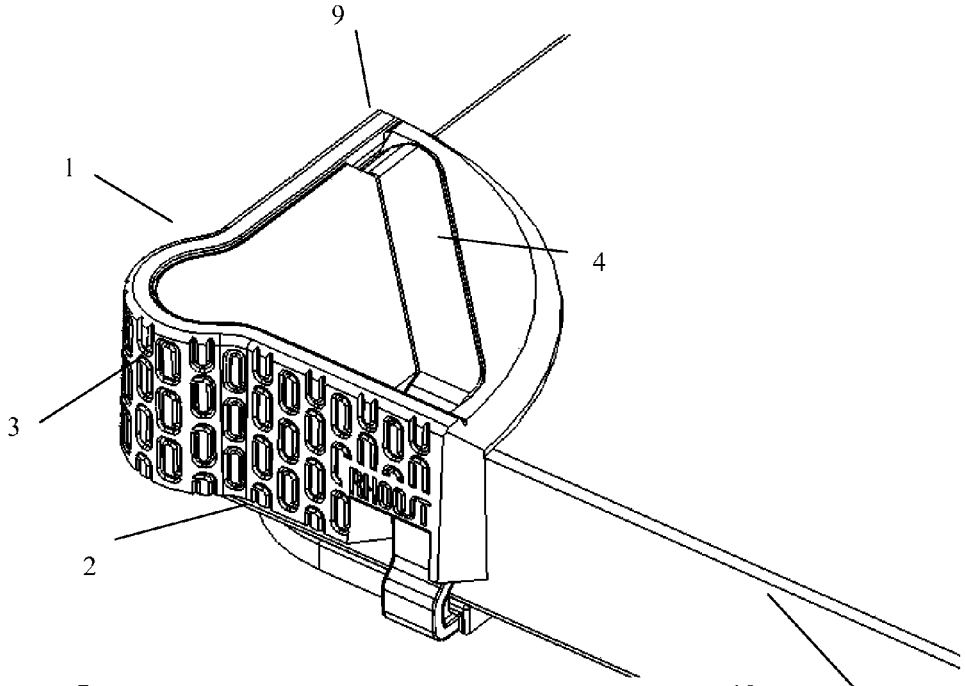
FIG. 1A is an oblique view of the guard strapped to the table.

Referring to FIGS. 1A through 5B, a corner protector 1 disclosed herein includes a guard 9 for fitting over the top of the table 6, and a means for securing the guard 9 to the table 6. In one embodiment, the means for securing the guard 9 to the table 6 includes a strap 4 and either a plate 15, as shown in FIGS. 4A-5B, or a rod 20, as shown in FIGS. 6A-6B. To secure the guard 9 to a corner, the guard 9 is placed over the surface of the table 6 to be protected. The strap 4, which has two or more connection members 14 (e.g., FIG. 4A) to allow the corner protector 1 to be adjusted vertically, secures the guard 9 to a corner to be protected. The strap 4 is secured by coupling the connection members 14 on the strap 4 with the locking members 16, 17, or 18 on the plate 15 or on the rod 20.

In the embodiment with a plate 15, the plate 15 is positioned beneath the guard 9 on a bottom surface of the table 6 to be protected, and when the strap 4 is secured to the plate 15, the corner protector 1 is firmly but releasably clamped to the table 6.

Figure 4A:
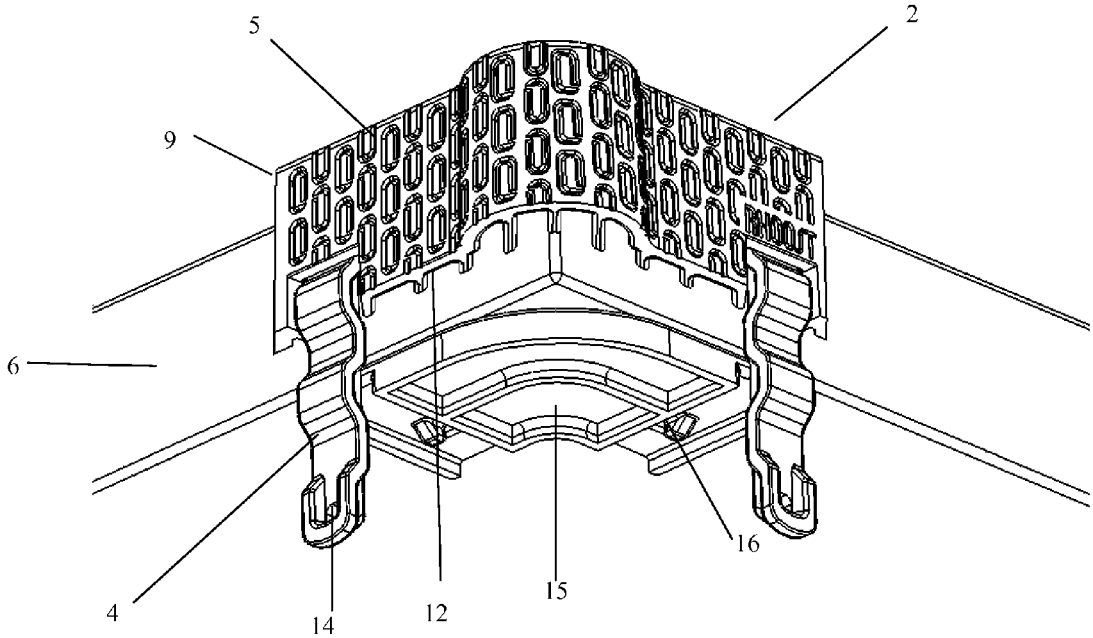
FIG. 4A is an oblique view of the guard, plate, and strap.
Figure 4B:
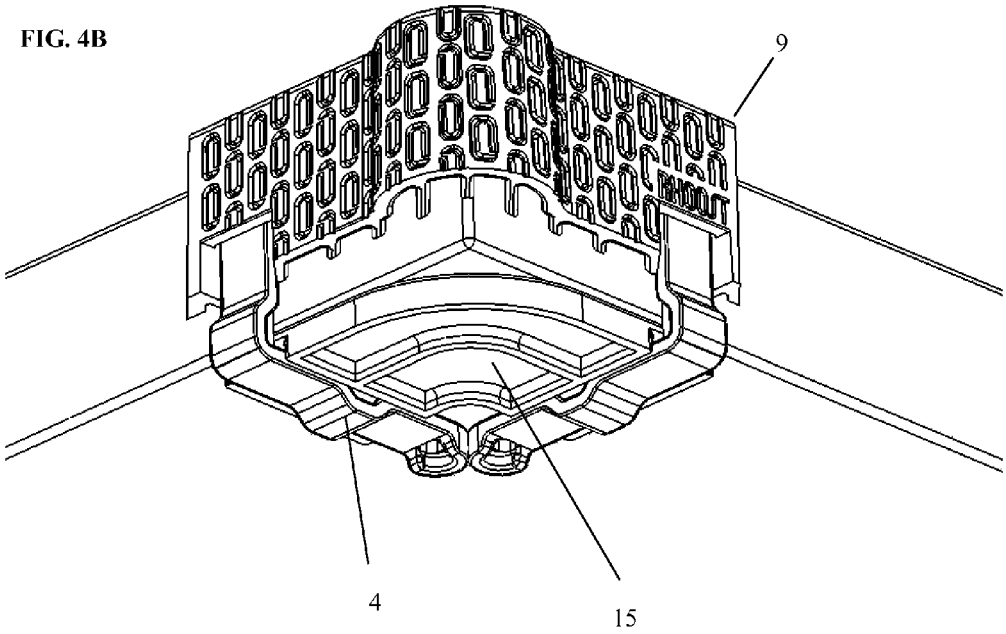
FIG. 4B is an oblique view of the guard with the strap connected to the plate.

The corner protector thus provides for a guard 9 and a strap 4 for securing the guard 9 to a corner as shown in FIGS. 1A and 4B. Also disclosed is a method for securing a guard 9 to a corner using a strap 4.

The guard 9 has a first top portion 7, first side portion 2, and second side portion 5. The side portions 2 and 5 are substantially orthogonal to the top portion 7, and substantially orthogonal to each other. The first portion 2 and the second portion 5 meet at the corner of the table 6 at a corner protrusion 3, as shown in FIGS. 1A-2B. The corner protrusion 3 is shaped so as to create a buffer region by providing a volume of flexible material that extends away from the corner. In one embodiment, the corner protrusion 3 is substantially semi-circle shaped, as shown in, e.g., FIG. 1A. In another embodiment, the guard 9 slopes vertically, in an outward direction from the first portion 7, as shown in, e.g., FIGS. 2A and 2B. In yet another embodiment, the region formed by the meeting of the portion 2 and the portion 5 forms a space that is capable of providing a cushion if a person comes into hard contact with the corner the table 6 by providing a relatively large volume of flexible material to absorb and redistribute force caused by an individual falling onto the corner protector 1.

The portion 2 and the portion 5 can have textured outer surfaces to increase friction and/or shock absorbance to help minimize injuries. FIGS. 1A-2B and 4A-4B show the portion 2 and the portion 5 with an array of ovals, but the textured outer surfaces can be any other shape capable of increasing friction and/or shock absorbance if someone falls onto the corner protector 1.

Figure 3:
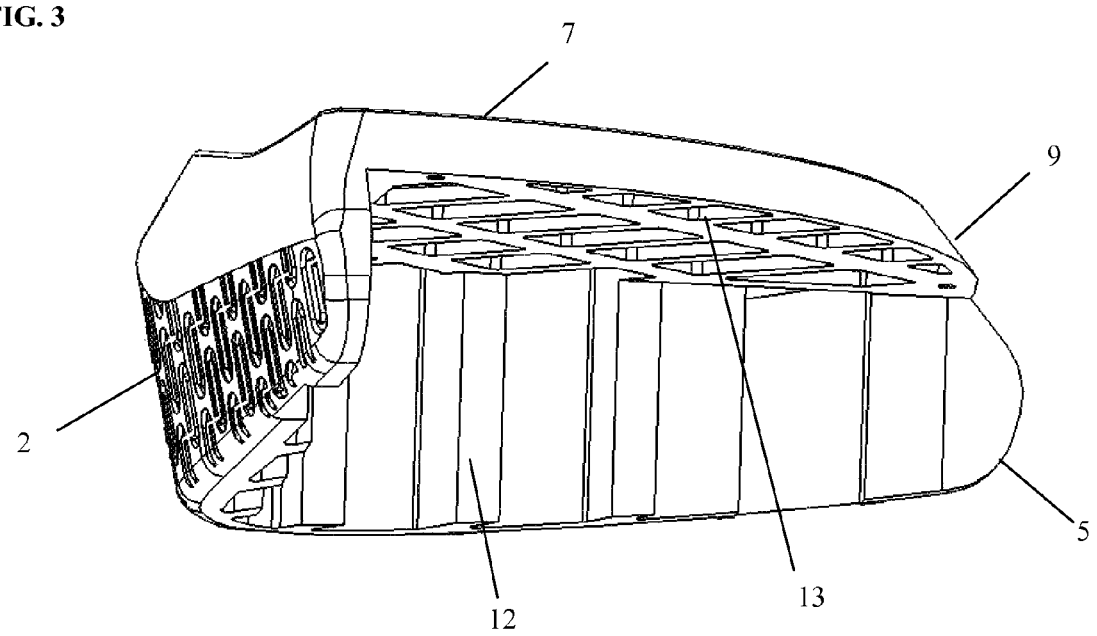
FIG. 3 is a side perspective view of the guard.

Referring to FIG. 3, which is a side perspective view of the guard 9, the inwardly facing sides of the portion 2 and the portion 5 have substantially vertical ribs 12 projecting inwardly from them so that the ribs 12 contact the table 6 when the guard 9 is mounted. The ribs 12 are flexible such that they can bend and redistribute force to other areas of the corner protector 1 and table 6 when pressure is applied to the exterior surfaces of the guard 9.

Figure 1B:
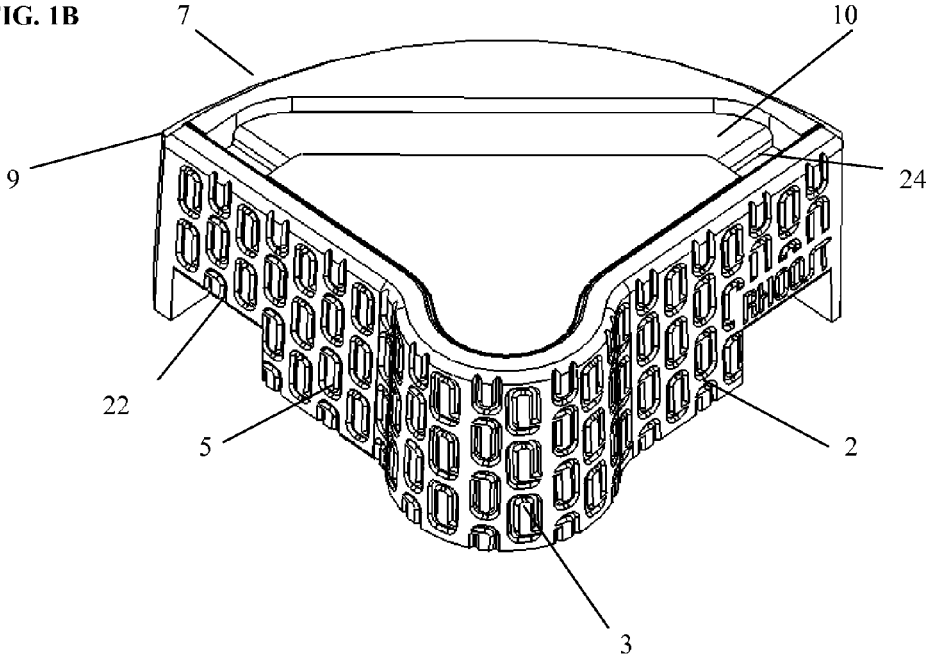
FIG. 1B is an oblique view of the guard with a semi-circle shaped corner protrusion.
Figure 2A:
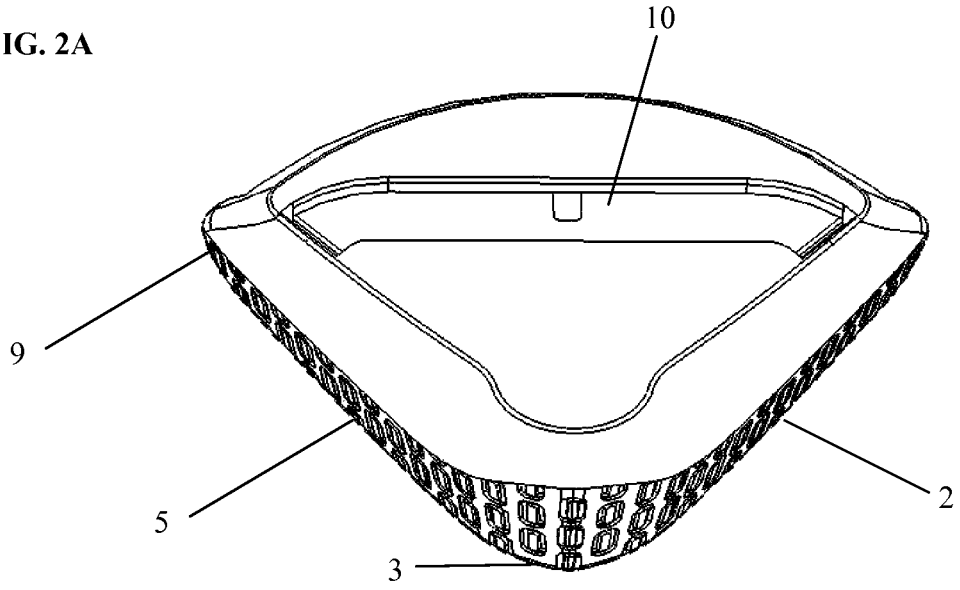
FIG. 2A is an oblique view of the guard with a sloped corner protrusion.
Figure 2B:
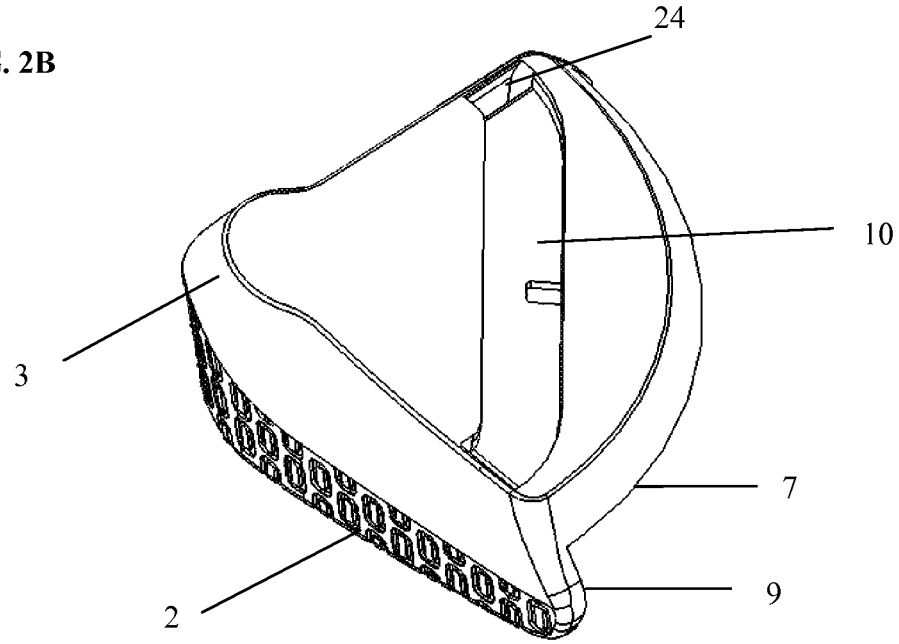
FIG. 2B is a side perspective view of the guard with a sloped corner protrusion.

Referring to FIGS. 1B and 2B, there are openings 24 at the top surface of the top portion 7 for inserting the strap 4. There can also be openings 22 on the outer surfaces of the second portion 2 and the third portion 5 for inserting the strap (FIG. 1B).

An underside of the first portion 7 has an inwardly extending raised grid 13 that is shaped to contact the top of the table 6 when the corner protector 1 is in place to help prevent the corner protector 1 from inadvertently sliding off the corner edge 6, and also provides further cushioning. The grid 13 can form a cross-hatch pattern as shown in FIG. 3.

Referring to FIGS. 1A, 1B, 2A, and 2B, the top first portion 7 of the guard 9 optionally has a recess 10 in which the strap 4 sits, such that when the strap 4 is in place, it is substantially flush with the top surface of the top portion 7, as shown in FIG. 1A. The recess 10 helps to seat the strap 4 and can have dimensions that conform to the cross-section of the strap 4. Referring also to FIGS. 4A and 4B, the side portions 2 and 5 each have slots through which the strap 4 passes. The strap 4 thus passes over the top of the guard 9 and through the sides such that the ends of the strap 4 are under the guard 9.

The strap 4 has at least two connection members 14, and can have two, four, six, eight, or more connection members 14, with half of the connection members 14 at each end. The connection members 14 can include holes (FIG. 6B), indents, detents, openings on an inside surface of the strap 4 for mating with locking members 16, 17, or 18 (FIGS. 1A, 4A, and 4B), a hook-and-eye connection, or any other form of connection that allows the strap 4 to be manually attached and opened to secure or release the corner protector 1.

Figure 5A:
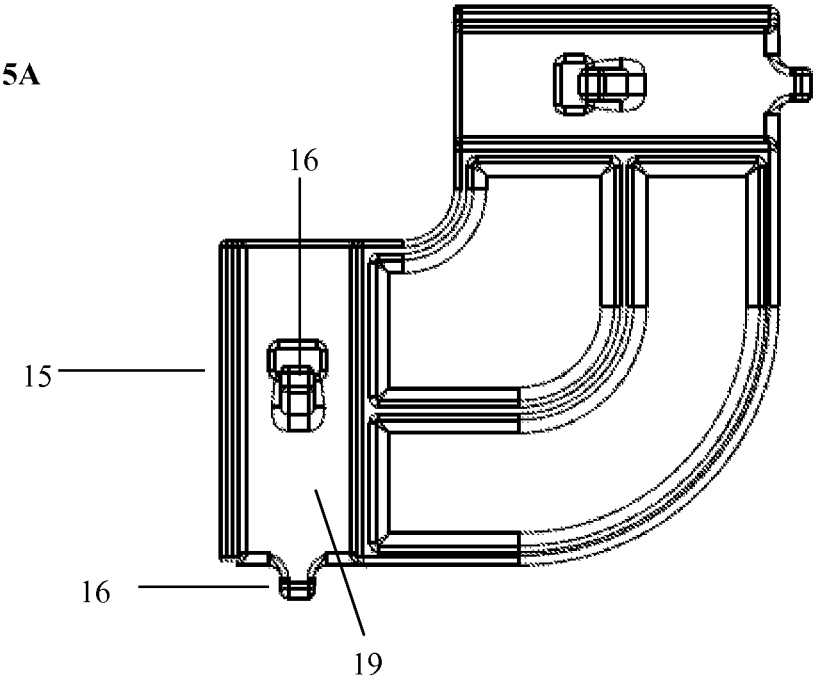
FIG. 5A is a top view of the plate.
Figure 5B:
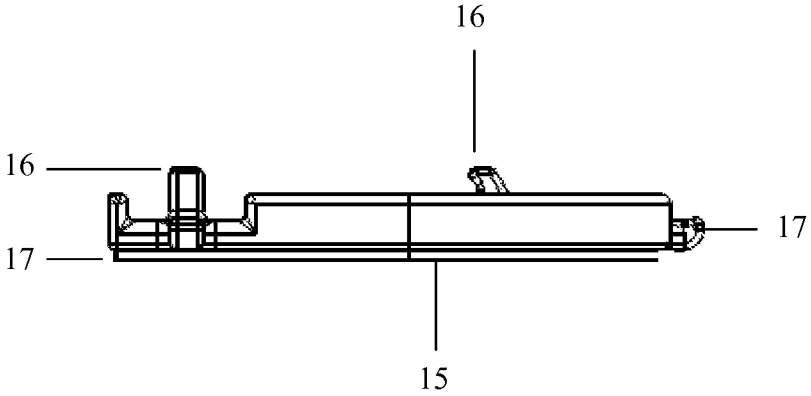
FIG. 5B is a lateral view of the plate.
Figure 6A:
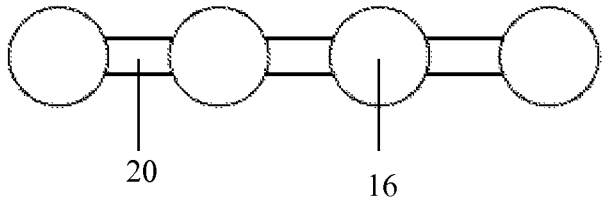
FIG. 6A is a lateral perspective view of the rod.
Figure 6B:
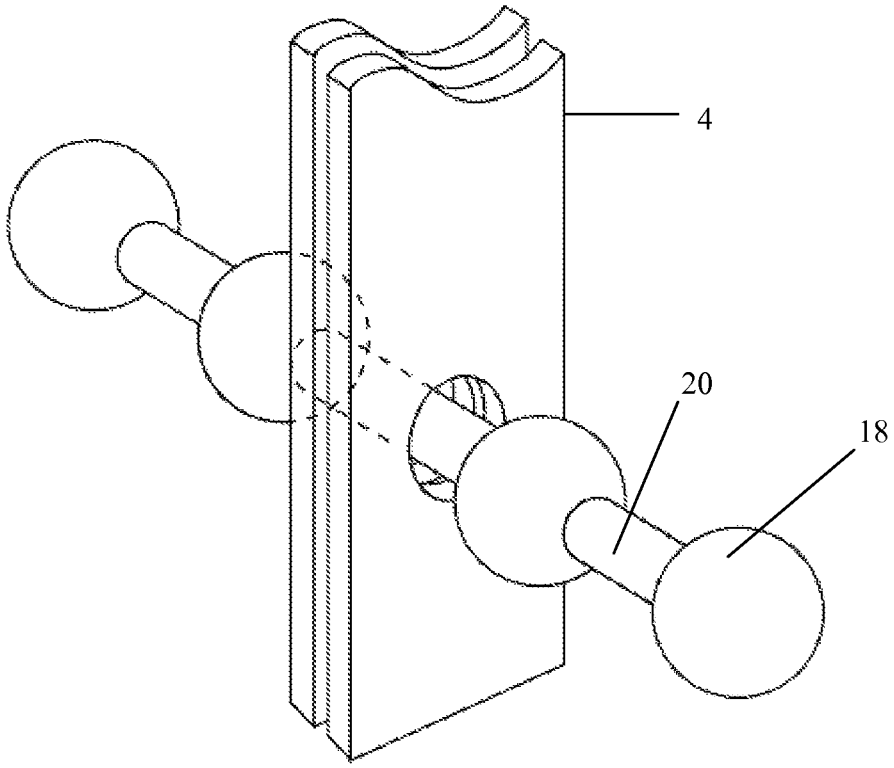
FIG. 6B is an oblique view of the rod inserted into the connection members of the strap.

Referring particularly to FIGS. 5A and 5B, the plate 15 is shown with two locking members 16. In some embodiments, the plate 15 has four or more locking members 16 and 17. The locking members 16 and 17 can extend downwardly (16), outwardly (17), or a combination thereof, as shown in FIG. 5B (the top of FIG. 5B is the downwardly facing side). Further, the plate 15 optionally has substantially linear channels 19 sized to conform to a width of the strap 4. These channels 19 help prevent lateral movement of the strap 4 to maintain a secure attachment to the table 6.

In another embodiment, shown in FIGS. 6A and 6B, the corner protector 1 has a rod 20 for securing the ends of the strap 4. This configuration can be useful for tables 6 on which the corner is flush or nearly flush with a leg of the table. The rod 20 can include a linear or non-linear (for example, rounded or angled) rod 20 with locking members 18. The rod 20 is inserted through the connection members 14 of the strap 4. The locking members 18 are shaped such that they secure the position of the rod 20 in the connection members 14. The locking members 18 on the rod 20 can be spherical or any shape that can extend through an opening of the strap 4 and then secure the strap 4 in place.

The corner protector 1 is anchored to the corner by securing the strap 4 to the plate 15, rod 20, or other means for securing the strap 4. The strap 4 runs alongside the vertical surfaces of a table 6, as shown in FIG. 4A. The connection members 14 on the strap 4 are connected to the downwardly extending locking members 16 and/or the outwardly extending locking members 17 on the plate 15, as shown in FIG. 4B, or the locking members 18 on the rod 20, as shown in FIG. 6B.

The guard 9, plate 15, rod 20, or other means for securing the strap 4, and strap 4 can be made of various materials. In one embodiment, the strap 4 is made of an elastomeric material. In another embodiment, the plate 15, or other means for securing the strap 4, is made of a rigid, durable material. In yet another embodiment, the rod 20 is made of a more rigid or flexible material.

In one embodiment, the guard 9 is more rigid relative to the strap 4, and the plate 15 is more rigid relative to both the strap 4 and the guard 9. In another embodiment, the guard 9 is made from a material with a lower durometer relative to the strap 4 and/or the plate 9 to provide "softness" in the part that will absorb contact. In another embodiment, the strap 4 is made from a material with a lower durometer relative to the guard and plate 15. In one embodiment, the plate 15 is made from a material with a higher durometer relative to the strap 4 and guard 9 to provide more stability. The rod 20 can be made from a material with a higher durometer relative to the strap 4 or guard 9. In another embodiment, the rod 20 is made from a material with a lower durometer relative to that used to make the guard 9 or strap 4.

In one embodiment, the materials are biodegradable and/or recyclable. One or more of the guard 9, strap 4, rod 20, and plate 15 can be made from a polymer, or an elastomer, or natural or synthetic rubber. In one embodiment, the guard 9 is made from an elastomer sold under the trademark Santoprene. The guard 9 can have an additional optional, rigid insert on the underside made from a more durable plastic to provide stability. In another embodiment, the strap 4 is made from silicone rubber. In still another embodiment, the plate and rod 20 are made from Santoprene.

For convenience, certain terms employed in the specification, examples, and appended claims are collected here. Unless defined otherwise, all technical and scientific terms used herein have the same meaning as commonly understood by one of ordinary skill in the art to which this invention belongs. The initial definition provided for a group or term herein applies to that group or term throughout the present specification individually or as part of another group, unless otherwise indicated.

The articles "a" and "an" are used herein to refer to one or to more than one (i.e., to at least one) of the grammatical object of the article. By way of example, "an element" means one element or more than one element.

The term "or" is used herein to mean, and is used interchangeably with, the term "and/or," unless context clearly indicates otherwise.

The term "table" refers to any fixture, piece of furniture, or surface that has a corner or projecting edge, such as a typical table or a counter.

Terms such as "up" and "under" are used as terms of reference. While it is expected that often the guard would be used on top of a table, the corner protector could be inverted or on its side.

It is to be understood that while the methods and devices have been described in conjunction with the detailed description thereof, the foregoing description is intended to illustrate and not limit the scope of the inventions, which is defined by the scope of the appended claims. Other aspects, advantages, and modifications are within the scope of the following claims. For example, other types of strapping can be used. The guard could be molded with a monolithic strap with the strap on top or on the underside of the guard, or there can be multiple distinct straps connected to or formed with the guard.

What is claimed is:

1. A corner protector for protecting a corner of a household or commercial object comprising:

a unitary first body having a top portion, the top portion having an inner surface and an outer surface, a first side portion, the first side portion having an inner surface having vertical, flexible ribs projecting inwardly and an outer surface, and a second side portion, the second side portion having an inner surface having vertical, flexible ribs projecting inwardly and an outer surface, wherein the first and second side portions are substantially orthogonal to the top portion and to each other and define a corner shape for mounting over the corner of the object, and wherein the vertical, flexible ribs of the inner surface of the first side portion and the vertical, flexible ribs of the inner surface of the second side portion are configured to contact the object;

a second body having a surface facing the top portion of the first body and spaced from the top portion of the first body; and resilient means for adjustably connecting the first body and the second body, such that the means for adjustably connecting is shaped to wrap around a portion of the second body and the spacing between the second body and the top portion of the first body can be repeatedly adjusted to have different spacings, thereby allowing the corner protector to be adjustable for different thicknesses.

2. The protector of claim 1, wherein the means for adjustably connecting includes a strap with a plurality of discrete connection locations relative to the second body to allow multiple spacings.

3. The protector of claim 1, wherein the first and second side portions meet to define a corner protrusion that is substantially semi-circle shaped.

4. The protector of claim 1, wherein the first side portion and the second side portion meet to define a corner protrusion that slopes vertically.

5. The protector of claim 1, wherein the second body is made from a relatively rigid material compared to the material of the first body.

6. The protector of claim 1, wherein the first side portion and the second side portion include textured surfaces.

7. A corner protector for protecting a corner of a household or commercial object, comprising:

a unitary first body having a first top portion in a first plane, the top portion having an inner surface and an outer surface, a first side portion, the first side portion having an inner surface having vertical, flexible ribs projecting inwardly and an outer surface, and a second side portion disposed in a second side plane, the second side portion having an inner surface having vertical, flexible ribs projecting inwardly and an outer surface, wherein the first and second side portions are substantially orthogonal to the top portion and to each other and define a corner shape for mounting over the corner of the object, and wherein the vertical, flexible ribs of the inner surface of the first side portion and the vertical, flexible ribs of the inner surface of the second side portion are configured to contact the object;

a second body for use in a plane substantially parallel to the first plane;

a resilient strap in contact with the first body, extending from the first body in a direction orthogonal to the first plane and adjacent to a portion of an object to be protected, and shaped to wrap around a portion of the second body; and means for adjustably securing the strap such that the corner protector can be clamped about various thicknesses of the object whose corner is being protected, and thereafter unclamped and re-clamped to provide a different spacing between the first body and the second body.

8. The protector of claim 7, wherein the first side portion and the second side portion meet to define a corner protrusion that is substantially semi-circle shaped.

9. The protector of claim 7, wherein the first side portion and the second side portion meet to define a corner protrusion that slopes vertically.

10. A corner protector for protecting a corner of a household or commercial object comprising:

a unitary first body having a top portion in a first plane, the top portion having an inner surface and an outer surface, a first side portion, the first side portion having an inner surface having vertical, flexible ribs projecting inwardly and an outer surface, and a second side portion, the second side portion having an inner surface having vertical, flexible ribs projecting inwardly and an outer surface, wherein the first side portion and the second side portion are generally orthogonal to the first plane and to each other and define a corner shape for mounting over the corner of the object, wherein the vertical flexible ribs of the inner surface of the first side portion and the vertical, flexible ribs of the inner surface of the second side portion are configured to contact the object, and wherein the top portion has a channel;

a second body for positioning parallel to and spaced from the top portion of the first body;

a resilient, flexible strap extending from the first body and having two ends, each end for connection to the second body at two different spaced locations, wherein at least a portion of the strap is in the channel.

11. The protector of claim 10, wherein the second body has locking members for locking with the ends of the strap, wherein multiple points of connection at each end for engaging the locking members such that the straps can be connected, disconnected, and reconnected at multiple positions such that the spacing between the second body and the top portion can be adjusted.

12. The protector of claim 10, wherein the second body is made from a relatively rigid material compared to the material of the first body.

13. The protector of claim 10, wherein the top portion, the first side portion and the second side portion meet at a rounded corner portion.

14. The protector of claim 10, wherein the first side portion and the second side portion include textured surfaces.

15. The protector of claim 10, wherein a top surface of the strap and a top surface of the top portion are co-planar when the strap is in the channel.

16. A corner protector for protecting a corner of a household or commercial object comprising:

a unitary first body made of one of polymer, elastomer, or rubber and having a top portion in a first plane, the top portion having an inner surface and an outer surface, a first side portion, the first side portion having an inner surface having vertical, flexible ribs projecting inwardly and an outer surface, and a second side portion, the second side portion having an inner surface having vertical, flexible ribs projecting inwardly and an outer surface, wherein the first side portion and the second side portion are generally orthogonal to the first plane and to each other and define a corner shape for mounting over the corner of the object, and wherein the vertical, flexible ribs of the inner surface of the first side portion and the vertical, flexible ribs of the inner surface of the second side portion are configured to contact the object;

a second body for positioning parallel to and spaced from the top portion of the first body;

a resilient, flexible strap extending from the first body and having two ends, each end for connection to the second body at two different spaced locations, wherein the second body has first and second channels, each for receiving an end of the strap, wherein the channels extend in directions that are orthogonal to each other.

17. The protector of claim 16, wherein the second body has locking members for locking with the ends of the strap, wherein multiple points of connection at each end for engaging the locking members such that the straps can be connected, disconnected, and reconnected at multiple positions such that the spacing between the second body and the top portion can be adjusted.

18. The protector of claim 16, wherein the second body is made from a relatively rigid material compared to the material of the first body.

19. The protector of claim 16, wherein the top portion, the first side portion, and the second side portion meet at a rounded corner portion.

20. The protector of claim 16, wherein the first side portion and the second side portion include textured surfaces.

* * * * *